US011259628B1

(12) United States Patent
Saniga

(10) Patent No.: US 11,259,628 B1
(45) Date of Patent: Mar. 1, 2022

(54) VACUUM DUSTER ATTACHMENT

(71) Applicant: Kyle Saniga, Savannah, GA (US)

(72) Inventor: Kyle Saniga, Savannah, GA (US)

( * ) Notice: Subject to any disclaimer, the term of this patent is extended or adjusted under 35 U.S.C. 154(b) by 212 days.

(21) Appl. No.: 16/716,641

(22) Filed: Dec. 17, 2019

(51) Int. Cl.

| | |
|---|---|
| ***A46B 15/00*** | (2006.01) |
| ***A47L 5/26*** | (2006.01) |
| ***A47L 13/38*** | (2006.01) |
| ***A47L 9/12*** | (2006.01) |
| ***A47L 9/22*** | (2006.01) |
| ***A47L 9/28*** | (2006.01) |
| ***A47L 9/04*** | (2006.01) |

(52) U.S. Cl.
CPC ..... *A46B 15/0053* (2013.01); *A47L 5/26* (2013.01); *A47L 9/0411* (2013.01); *A47L 9/122* (2013.01); *A47L 9/22* (2013.01); *A47L 9/2884* (2013.01); *A47L 13/38* (2013.01); *A46B 2200/3033* (2013.01)

(58) Field of Classification Search
CPC ..... A46B 15/0053; A46B 2200/3033; A47L 5/26; A47L 9/0411; A47L 9/122; A47L 9/22; A47L 9/2884; A47L 13/38
See application file for complete search history.

(56) References Cited

U.S. PATENT DOCUMENTS 4,956,892 A * 9/1990 Fawkes ..... A47L 5/24 15/339
5,794,303 A * 8/1998 Sanfilippo ..... A47L 5/26 15/339
6,370,731 B1 * 4/2002 Carter ..... A47L 9/06 15/393
7,784,137 B2 * 8/2010 Knopow ..... A46B 15/0002 15/22.1
7,784,149 B2 * 8/2010 Schwarz ..... A47L 9/06 15/344
8,875,341 B2 * 11/2014 Gooden ..... A47L 9/04 15/344
9,648,862 B1 * 5/2017 Lievano ..... A01M 7/005
D808,660 S * 1/2018 Kresge ..... D4/128
2003/0192143 A1 * 10/2003 Beynon ..... A47L 9/0411 15/304
2006/0179605 A1 * 8/2006 Greene ..... A47L 9/242 15/377
2006/0288508 A1 * 12/2006 Knopow ..... A47L 13/38 15/144.1
2008/0022484 A1 * 1/2008 Caruso ..... B25F 5/02 15/344

(Continued)

FOREIGN PATENT DOCUMENTS

WO WO-2006130963 A1 * 12/2006 ..... A47L 13/38
WO 2018237285 12/2018

*Primary Examiner* — Marc Carlson
(74) *Attorney, Agent, or Firm* — Kyle A. Fletcher, Esq.

(57) ABSTRACT

The vacuum duster attachment is a suction-based cleaning device. The vacuum duster attachment is a rotating device. The vacuum duster attachment forms a brush. The vacuum duster attachment simultaneously: a) dislodges particles from a surface; and, b) vacuums the dislodged particles into a dirt chamber for storage. The vacuum duster attachment comprises a vacuum structure, a brush structure, and a vacuum circuit. The brush structure attaches to the vacuum structure. The vacuum circuit installs in the vacuum structure. The vacuum circuit is a control circuit that controls the operation of the vacuum duster attachment.

18 Claims, 6 Drawing Sheets

(56) References Cited

U.S. PATENT DOCUMENTS

| | | | | |
|---|---|---|---|---|
| 2008/0086834 | A1* | 4/2008 | Schwarz | A47L 5/24 15/344 |
| 2012/0124771 | A1* | 5/2012 | Gooden | A47L 9/04 15/344 |
| 2017/0105591 | A1* | 4/2017 | Bernhard-Tanis | A47L 5/24 |
| 2017/0231456 | A1* | 8/2017 | Weilage | A47L 13/44 15/144.4 |
| 2018/0206693 | A1* | 7/2018 | Harrington | B25G 1/04 |
| 2018/0333020 | A1* | 11/2018 | Gordon | A47L 9/0673 |
| 2018/0353028 | A1* | 12/2018 | Goller | A47L 9/0666 |
| 2018/0353029 | A1* | 12/2018 | Tolchard | A47L 5/24 |
| 2018/0368649 | A1* | 12/2018 | Kresge | A47L 9/02 |

* cited by examiner

VACUUM DUSTER ATTACHMENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of domestic washing and cleaning devices including suction cleaners, more specifically, a suction cleaner with a power-driven air pump. (A47L5/12)

SUMMARY OF INVENTION

The vacuum duster attachment is a suction-based cleaning device. The vacuum duster attachment is a rotating device. The vacuum duster attachment forms a brush. The vacuum duster attachment simultaneously: a) dislodges particles from a surface; and, b) vacuums the dislodged particles into a dirt chamber for storage. The vacuum duster attachment comprises a vacuum structure, a brush structure, and a vacuum circuit. The brush structure attaches to the vacuum structure. The vacuum circuit installs in the vacuum structure. The vacuum circuit is a control circuit that controls the operation of the vacuum duster attachment.

These together with additional objects, features and advantages of the vacuum duster attachment will be readily apparent to those of ordinary skill in the art upon reading the following detailed description of the presently preferred, but nonetheless illustrative, embodiments when taken in conjunction with the accompanying drawings.

In this respect, before explaining the current embodiments of the vacuum duster attachment in detail, it is to be understood that the vacuum duster attachment is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the vacuum duster attachment.

It is therefore important that the claims be regarded as including such equivalent construction insofar as they do not depart from the spirit and scope of the vacuum duster attachment. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
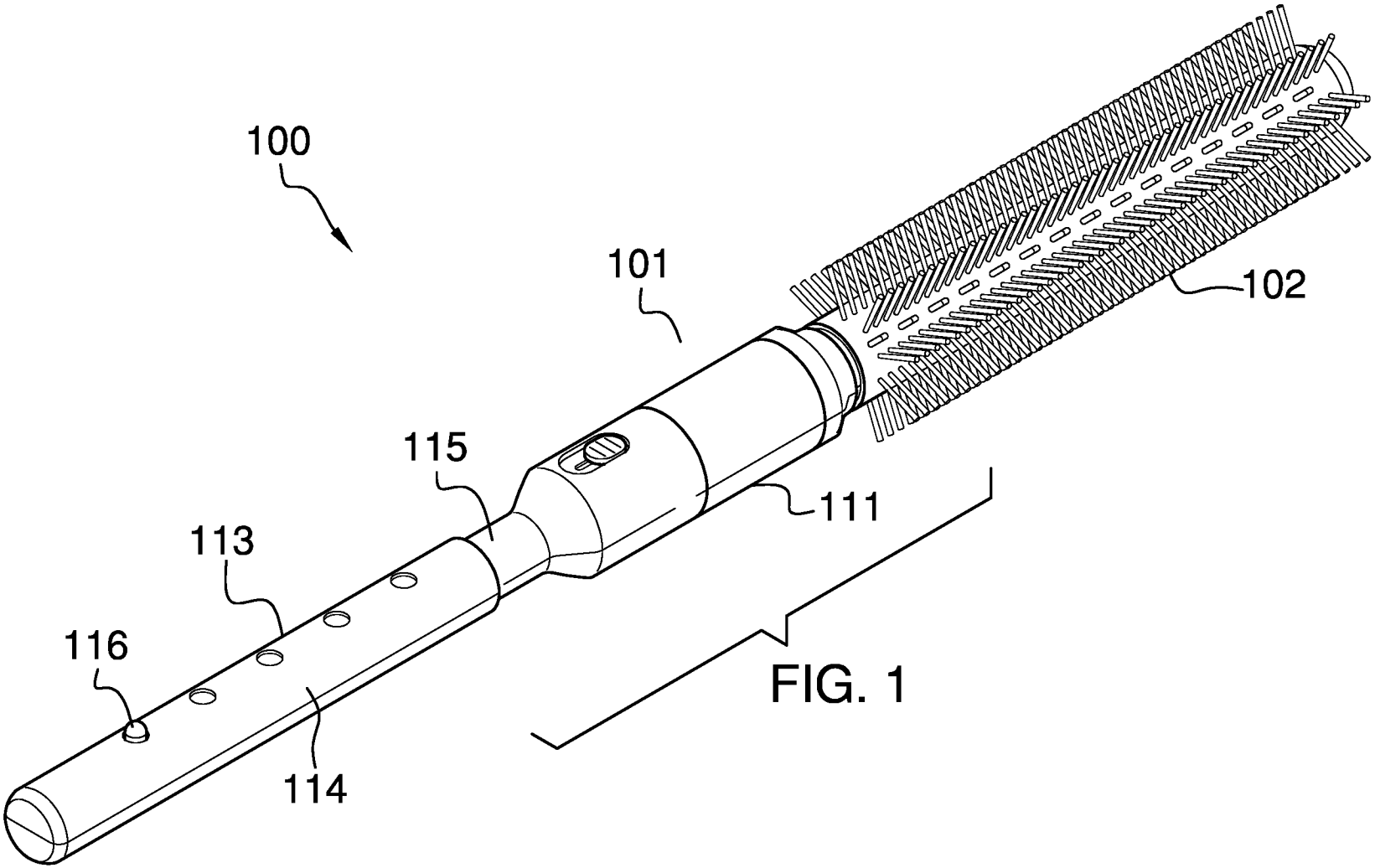
FIG. 1 is a perspective view of an embodiment of the disclosure.
Figure 2:
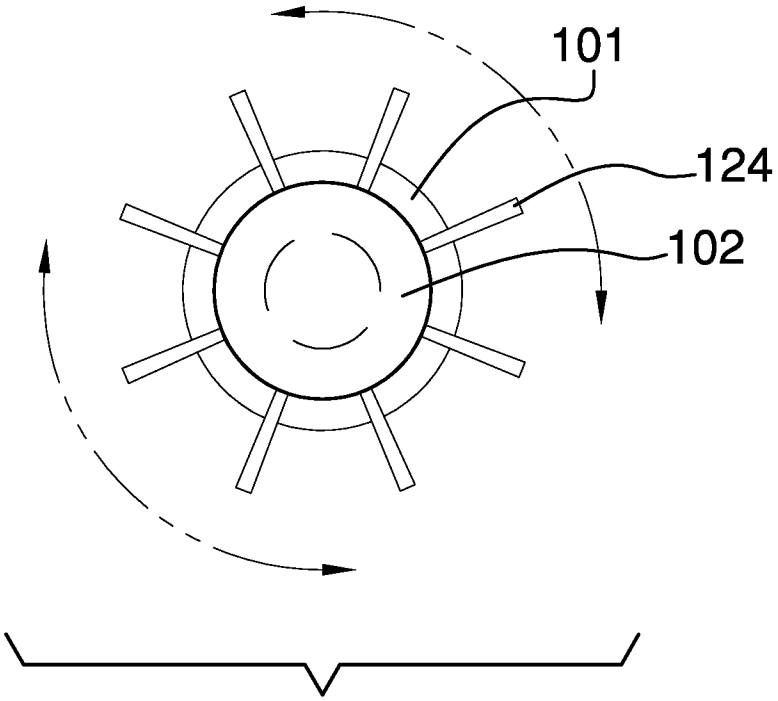
FIG. 2 is an end view of an embodiment of the disclosure.
Figure 3:
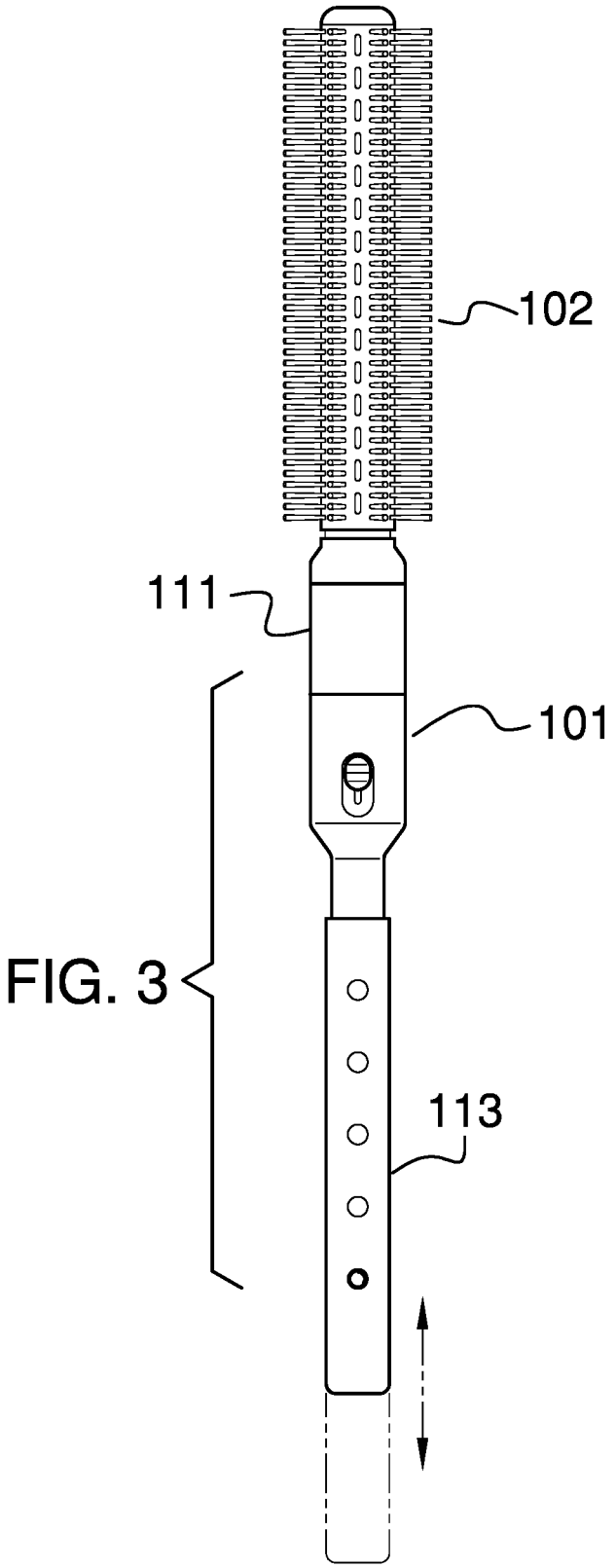
FIG. 3 is a side view of an embodiment of the disclosure.
Figure 4:
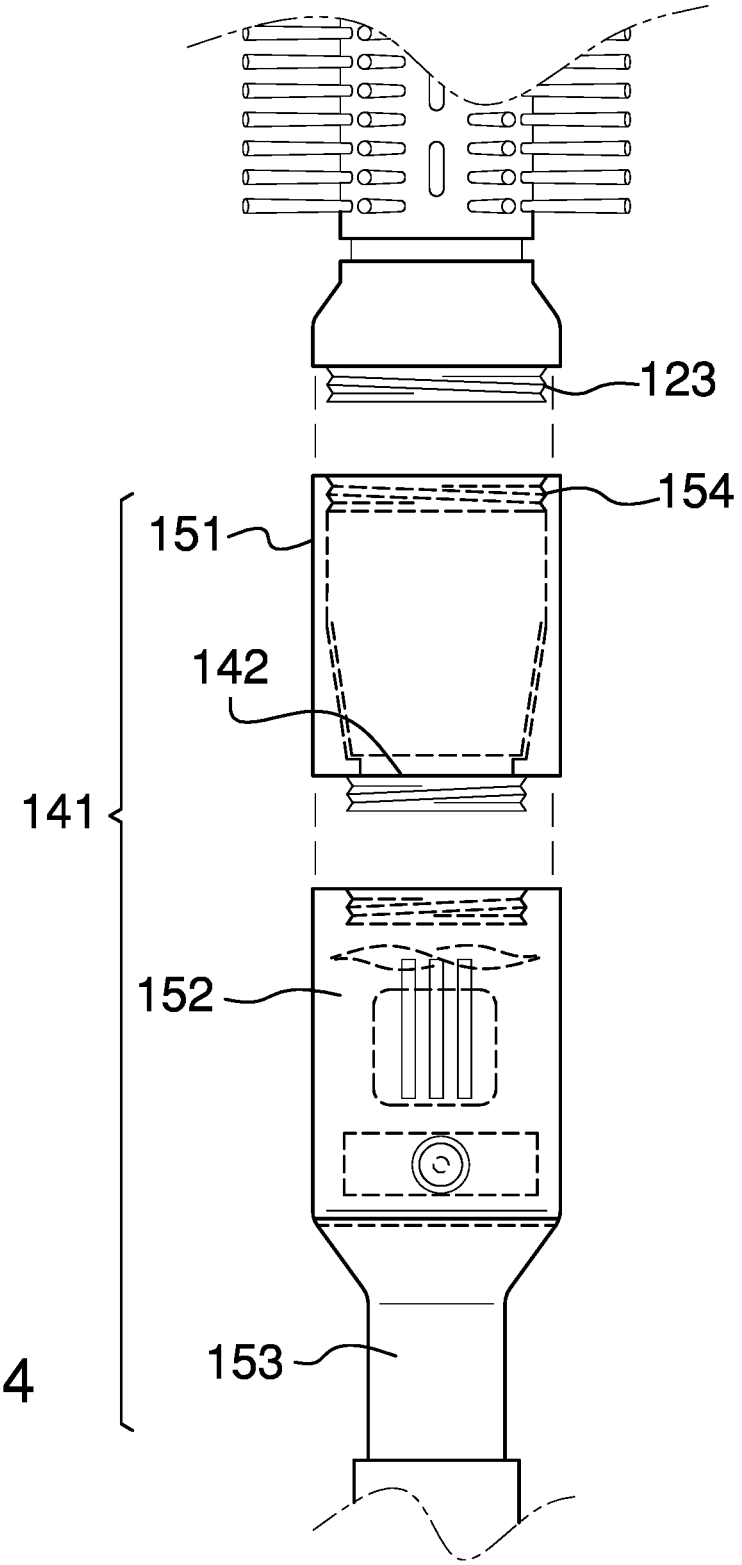
FIG. 4 is an exploded view of an embodiment of the disclosure.
Figure 5:
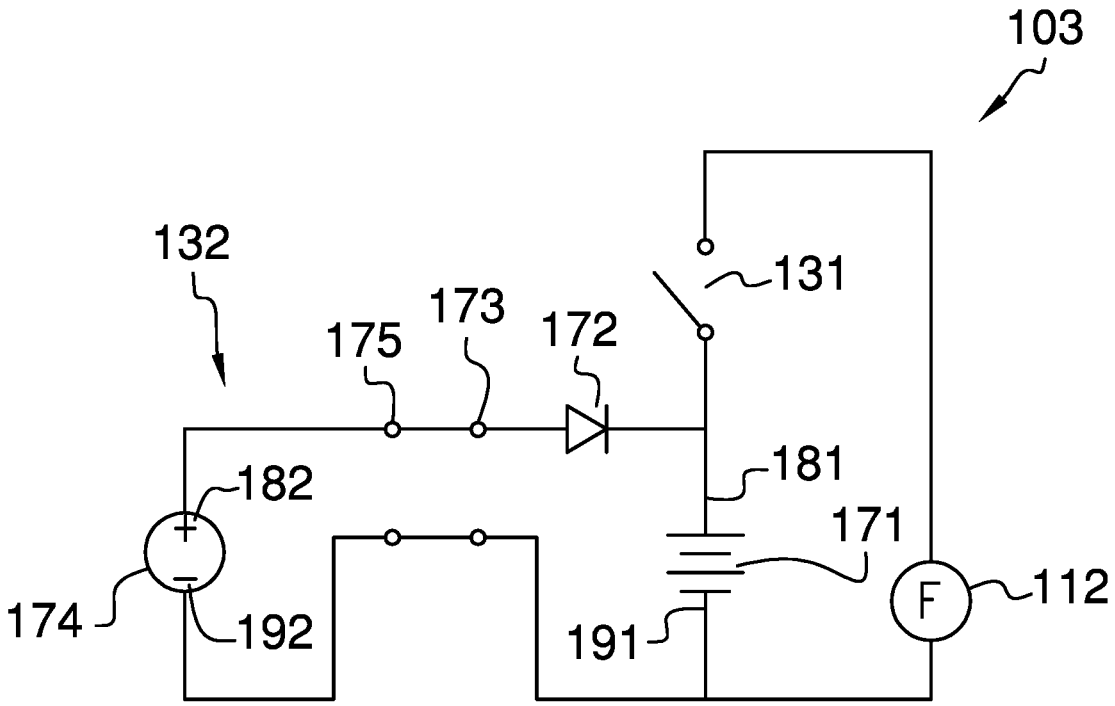
FIG. 5 is a schematic view of an embodiment of the disclosure.
Figure 6:
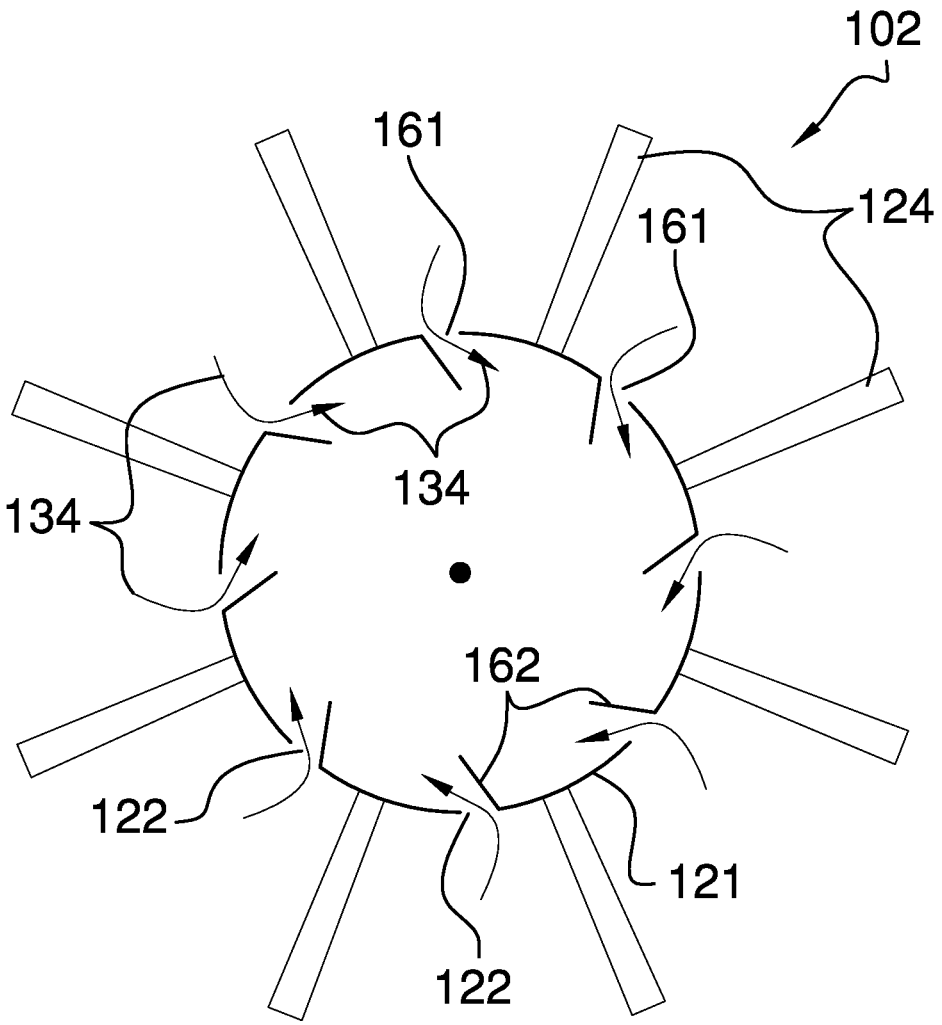
FIG. 6 is a cross-sectional view of an embodiment of the disclosure.

Detailed reference will now be made to one or more potential embodiments of the disclosure, which are illustrated in FIGS. 1 through 6.

The vacuum duster attachment 100 (hereinafter invention) is a suction-based cleaning device. The invention 100 is a rotating device. The invention 100 forms a brush. The invention 100 simultaneously: a) dislodges particles from a surface; and, b) vacuums the dislodged particles into a dirt chamber 151 for storage. The invention 100 comprises a vacuum structure 101, a brush structure 102, and a vacuum circuit 103. The brush structure 102 attaches to the vacuum structure 101. The vacuum circuit 103 installs in the vacuum structure 101. The vacuum circuit 103 is a control circuit that controls the operation of the invention 100.

The vacuum structure 101 is a housing. Specifically, the vacuum structure 101 is a rigid casing. The vacuum structure 101 contains the vacuum circuit 103. The brush structure 102 attaches to the vacuum structure 101. The vacuum structure 101 is formed with all apertures and form factors necessary to allow the vacuum structure 101 to accommodate the use and operation of the invention 100. Methods to form a vacuum structure 101 suitable for the purposes described in this disclosure are well-known and documented in the mechanical arts. The vacuum structure 101 stores the particulate matter drawn into the vacuum structure 101 by the brush structure 102. The vacuum structure 101 comprises a vacuum housing 111, a vacuum fan 112, and a telescopic handle 113.

The vacuum housing 111 is a composite prism structure. The vacuum housing 111 contains the vacuum circuit 103. The brush structure 102 attaches to the vacuum housing 111. The vacuum housing 111 is formed with all apertures and form factors necessary to allow the vacuum housing 111 to accommodate the use and operation of the invention 100. Methods to form a vacuum housing 111 suitable for the purposes described in this disclosure are well-known and documented in the mechanical arts. The vacuum housing 111 comprises a housing shell 141 and a filter 142.

The housing shell 141 is a hollow composite prism structure. The housing shell 141 has a capped tube structure. The housing shell 141 is formed as a segmented tube. The housing shell 141 is formed as a center capped tube. The housing shell 141 further comprises a dirt chamber 151, a vacuum chamber 152, and a circuit chamber 153.

The dirt chamber 151 is a tubular structure. The dirt chamber 151 is a prism-shaped structure. The congruent ends of the dirt chamber 151 are geometrically identical to the congruent ends of the vacuum chamber 152 and the circuit chamber 153. The dirt chamber 151 attaches the vacuum chamber 152 to the open congruent end of the capped tube structure of the brush structure 102. The dirt chamber 151 further comprises an interior screw thread 154.

The interior screw thread 154 is formed on the end of the dirt chamber 151 that is distal from the vacuum chamber 152. The interior screw thread 154 is sized to receive the exterior screw thread 123 of the brush structure 102. The exterior screw thread 123 attaches the brush structure 102 by screwing into the interior screw thread 154 of the dirt chamber 151 of the vacuum structure 101.

The vacuum chamber 152 is a capped structure. The vacuum chamber 152 is a prism-shaped structure. The congruent ends of the vacuum chamber 152 are geometrically identical to the congruent ends of the circuit chamber 153. The vacuum chamber 152 attaches the circuit chamber 153 to the dirt chamber 151. The vacuum chamber 152 contains the vacuum fan 112. The vacuum chamber 152 and the dirt chamber 151 are joined to form a composite prism structure. The vacuum chamber 152 and the dirt chamber 151 are joined to form a segmented tube. The vacuum chamber 152 and the dirt chamber 151 are bifurcated into their segments by the filter 142. The vacuum chamber 152 is formed with apertures that discharges the airflow 134. The vacuum fan mounts in the vacuum chamber 152.

The circuit chamber 153 is a tubular structure with two closed ends. The circuit chamber 153 is a prism-shaped structure. The congruent ends of the circuit chamber 153 are geometrically identical to the congruent ends of the vacuum chamber 152. The circuit chamber 153 attaches to the vacuum chamber 152 to form a composite prism structure. The circuit chamber 153 attaches to the vacuum chamber 152 to form a capped tube structure. The circuit chamber 153 contains the vacuum circuit 103. The circuit chamber 153 is formed with all apertures required to accommodate the operation of the vacuum circuit 103.

The filter 142 is a disk-shaped surface filter 142. The filter 142 installs in the hollow tubular structure of the housing shell 141. The filter 142 bifurcates the interior space of the housing shell 141 to form the segmented sections of the segmented tube structure of the housing shell 141. Specifically, the filter 142 separates the dirt chamber 151 from the vacuum chamber 152 such that the airflow 134 is filtered as it passes through the filter 142. The airflow 134 passes through the filter 142 as it flows from the dirt chamber 151 into the vacuum chamber 152. The filter 142 removes the particulate matter from the airflow 134 as the airflow 134 passes through the filter 142. The particulate matter is stored within the dirt chamber 151.

The vacuum fan 112 is an electrically powered device. The vacuum fan 112 is a bladed device that generates a pressure differential that creates a partial vacuum. The partial vacuum created by the vacuum fan 112 draws the particulate matter released from a surface into the interior of the brush structure 102 for transport into the vacuum structure 101.

The telescopic handle 113 is a grip used to carry and manipulate the invention 100. The span of the length of the telescopic handle 113 is adjustable. The telescopic handle 113 attaches to the congruent end of the circuit chamber 153 of the housing shell 141 of the vacuum housing 111 of the vacuum structure 101 that is distal from the brush structure 102. The telescopic handle 113 further comprises a first arm 114, a second arm 115, and a detent 116.

The detent 116 is a mechanical structure that locks and secures the first arm 114 to the second arm 115. The first arm 114 is a hollow first prism-shaped structure that is further defined with an inner dimension. The second arm 115 is a second prism-shaped structure that is further defined with an outer dimension. The first arm 114 and the second arm 115 are geometrically similar. The span of the outer dimension of the second arm 115 is less than the span of the inner dimension of the first arm 114 such that the second arm 115 inserts into the first arm 114 in a telescopic manner to form a composite prism structure. This span of the length of the telescopic handle 113 adjusts by adjusting the relative position of the second arm 115 within the first arm 114.

The position of the second arm 115 relative to the first arm 114 is held in position using the detent 116. The detent 116 is selected from the group consisting of a cotter pin, a G snap collar, a cam lock collar, a threaded clutch, a split collar lock, or a spring-loaded ball lock.

The brush structure 102 is a mechanical structure. The brush structure 102 has the primary shape of a prism. The brush structure 102 is a hollow structure. The brush structure 102 is a tubular structure. The brush structure 102 forms a fluidic connection from the exterior of the invention 100 into the vacuum structure 101. The brush structure 102 is a rotating structure. The rotation of the brush structure 102 releases the particulate matter from a surface and draws the released particulate matter into the interior of the brush structure 102 for transport into the vacuum structure 101. The brush structure 102 comprises a foraminous tube 121, a plurality of inlet structures 122, an exterior screw thread 123, and a plurality of bristles 124.

The foraminous tube 121 is a prism-shaped structure. The foraminous tube 121 is a hollow structure. The foraminous tube has the structure of a capped tube. The foraminous tube 121 is a rotating structure. The foraminous tube 121 forms the primary shape of the brush structure 102. The lateral face of the foraminous tube 121 is formed as a foraminous surface through which the airflow 134 that passes into the invention 100 flows.

The plurality of inlet structures 122 comprises the collection of apertures that forms the foraminous surface of the foraminous tube 121. The airflow 134 passes through the plurality of inlet structures 122 from the exterior of the foraminous tube 121 into the interior of the foraminous tube 121. Each of the plurality of inlet structures 122 is identical. Each of the plurality of inlet structures 122 further comprises an intake aperture 161 and an intake blade 162.

Each intake aperture 161 is an aperture formed through the lateral face of the foraminous tube 121. Each intake aperture 161 allows a portion of the airflow 134 to flow into the hollow interior of the foraminous tube 121.

Each intake blade 162 is a blade that mounts on the interior surface of the foraminous tube 121 such that the intake blade 162 partially blocks the intake aperture 161 associated with the intake blade 162. The intake blade 162 deflects the direction of the airflow 134 that passes through the intake aperture 161. The deflection of the airflow 134 by the intake blade 162 generates an opposing force on the intake blade 162 that provides a portion of the motive forces that allow the foraminous tube 121 to rotate.

The exterior screw thread 123 is an exterior screw thread that attaches the brush structure 102 to the vacuum structure 101. The exterior screw thread 123 is defined elsewhere in this disclosure. The foraminous tube 121 attaches to the exterior screw thread 123 such that the foraminous tube 121 rotates relative to the exterior screw thread 123.

The plurality of bristles 124 attach to the exterior surface of the lateral face of the foraminous tube 121. Each of the plurality of bristles 124 attaches to the foraminous tube 121 in the manner of a cantilever. The plurality of bristles 124 are placed against a surface such that the rotation of the foraminous tube 121 allows the friction generated by the plurality of bristles 124 to release the particulate matter from the surface.

The vacuum circuit 103 is an electric circuit. The vacuum circuit 103 generates a vacuum that creates an airflow 134 through the vacuum structure 101 and the brush structure 102. The vacuum generated by the vacuum circuit 103 creates an airflow 134 through the lateral face of the foraminous tube 121 into the brush structure 102 and through the hollow structure of the brush structure 102 into the vacuum structure 101. The vacuum structure 101 contains the vacuum circuit 103. The vacuum circuit 103 is an independently powered electric circuit. By independently powered is meant that the vacuum circuit 103 can operate without an electrical connection to an external power source 174. The vacuum circuit 103 comprises a master switch 131, a power circuit 132, and the vacuum fan 112. The master switch 131, the power circuit 132, and the vacuum fan 112 are electrically interconnected.

The master switch 131 is an electric switch. The master switch 131 forms a series electric connection between the power circuit 132 and the vacuum fan 112. The master switch 131 controls the flow of electric power from the power circuit 132 to the vacuum fan 112.

The power circuit 132 is an electrical circuit. The power circuit 132 powers the operation of the vacuum circuit 103. The power circuit 132 is an electrochemical device. The power circuit 132 converts chemical potential energy into the electrical energy required to power the vacuum circuit 103. The power circuit 132 further comprises a battery 171, a diode 172, a charging port 173, and an external power source 174. The external power source 174 further comprises a charging plug 175. The battery 171, the diode 172, the charging port 173, the external power source 174, and the charging plug 175 are electrically interconnected. The battery 171 is further defined with a first positive terminal 181 and a first negative terminal 191. The external power source 174 is further defined with a second positive terminal 182 and a second negative terminal 192.

The battery 171 is an electrochemical device. The battery 171 converts chemical potential energy into the electrical energy used to power the vacuum circuit 103. The battery 171 is a commercially available rechargeable battery 171. The chemical energy stored within the rechargeable battery 171 is renewed and restored through the use of the charging port 173. The charging port 173 is an electrical circuit that reverses the polarity of the rechargeable battery 171 and provides the energy necessary to reverse the chemical processes that the rechargeable battery 171 initially used to generate the electrical energy. This reversal of the chemical process creates a chemical potential energy that will later be used by the rechargeable battery 171 to generate electricity.

The charging port 173 forms an electrical connection to an external power source 174 using a charging plug 175. The charging plug 175 forms a detachable electrical connection with the charging port 173. The charging port 173 receives electrical energy from the external power source 174 through the charging plug 175. The diode 172 is an electrical device that allows current to flow in only one direction. The diode 172 installs between the rechargeable battery 171 and the charging port 173 such that electricity will not flow from the first positive terminal 181 of the rechargeable battery 171 into the second positive terminal 182 of the external power source 174. In the first potential embodiment of the disclosure, the external power source 174, the charging plug 175, and the charging port 173 are compatible with USB power requirements.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Aperture: As used in this disclosure, an aperture is a prism-shaped negative space that is formed completely through a structure or the surface of a structure.

Battery: As used in this disclosure, a battery is a chemical device consisting of one or more cells, in which chemical energy is converted into electricity and used as a source of power. Batteries are commonly defined with a positive terminal and a negative terminal.

Blade: As used in this disclosure, a blade is a term that is used to describe a wide and flat structure or portion of a larger structure, such as a propeller.

Bristle: As used in this disclosure, a bristle is a short coarse stiff hair or hair-like object.

Brush: As used in this disclosure, a brush is a device comprising a plurality of bristles set into a handle or a base that is used for grooming, sweeping, smoothing, scrubbing, or painting.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Capped Tube: As used in this disclosure, a capped tube is a tube with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center Capped Tube: As used in this disclosure, a center capped tube is a tube with a first open end, a second open end, and a barrier that is fabricated within the tube. The barrier prevents the flow of liquid or gas from the first open end of the tube through to the second open end of the tube.

Chamber: As used in this disclosure, a chamber is an enclosed or enclosable negative space that is dedicated to a purpose.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Control Circuit: As used in this disclosure, a control circuit is an electrical circuit that manages and regulates the behavior or operation of a device.

Correspond: As used in this disclosure, the term correspond is used as a comparison between two or more objects wherein one or more properties shared by the two or more objects match, agree, or align within acceptable manufacturing tolerances.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Exterior Screw Thread: An exterior screw thread is a ridge wrapped around the outer surface of a tube in the form of a helical structure that is used to convert rotational movement into linear movement.

External Power Source: As used in this disclosure, an external power source is a source of the energy that is externally provided to enable the operation of the present disclosure. Examples of external power sources include, but are not limited to, electrical power sources and compressed air sources.

Filter: As used in this disclosure, a filter is a mechanical device that is used to separate solids that are suspended in a liquid or a gas. A strainer is type of filter with what would be considered a coarse mesh measurement.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Foraminous: As used in this disclosure, foraminous is an adjective that describes a surface, plate, or platform that is perforated with a plurality of apertures.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Housing: As used in this disclosure, a housing is a rigid structure that encloses and protects one or more devices.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior Screw Thread: An interior screw thread is a groove that is formed around the inner surface of a tube in the form of a helical structure that is used to convert rotational movement into linear movement.

Maintained Switch: A used in this disclosure, a maintained switch is a switch that maintains the position that was set in the most recent switch actuation. A maintained switch works in an opposite manner to a momentary switch.

Motor: As used in this disclosure, a motor refers to the method of transferring energy from an external power source into rotational mechanical energy.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Perimeter: As used in this disclosure, a perimeter is one or more curved or straight lines that bounds an enclosed area on a plane or surface. The perimeter of a circle is commonly referred to as a circumference.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Primary Shape: As used in this disclosure, the primary shape refers to a description of the overall geometric shape of an object that is assembled from multiple components.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Segmented Tube: As used in this disclosure, a segmented tube is a center capped tube wherein the barrier is formed as a filter. The barrier filters the liquid or gas as it flows from the first open end of the tube through to the second open end of the tube.

Surface Filter: As used in this disclosure, a surface filter is a type of filter wherein the fluid is passed through a surface or membrane, such as a screen or paper that allows for the passage of the fluid but blocks the passage of larger particles that may be suspended in the fluid. The construction of a surface filter would allow for the passage of the fluid through several filter surfaces in one filtration unit.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Telescopic: As used in this disclosure, telescopic is an adjective that describes an object made of sections that fit or slide into each other such that the object can be made longer or shorter by adjusting the relative positions of the sections.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Tube: As used in this disclosure, a tube is a hollow prism-shaped device formed with two open ends. The tube is used for transporting liquids and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

USB: As used in this disclosure, USB is an acronym for Universal Serial Bus which is an industry standard that defines the cables, the connectors, the communication protocols and the distribution of power required for interconnections between electronic devices. The USB standard defines several connectors including, but not limited to, USB-A, USB-B, mini-USB, and micro USB connectors. A USB cable refers to a cable that: 1) is terminated with USB connectors; and, 2) that meets the data transmission standards of the USB standard.

Vacuum: As used in this disclosure, vacuum is used to describe a first space that contains gas at a reduced gas pressure relative to the gas pressure of a second space. If the first space and the second space are connected together, this pressure differential will cause gas from the second space to move towards the first space until the pressure differential is eliminated.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A suction cleaning device comprising a vacuum structure, a brush structure, and a vacuum circuit;

wherein the brush structure attaches to the vacuum structure;

wherein the vacuum structure contains the vacuum circuit;

wherein the vacuum circuit is a control circuit that controls the operation of the suction cleaning device;

wherein the suction cleaning device is a suction-based cleaning device;

wherein the suction cleaning device is a rotating device;

wherein the suction cleaning device forms a brush;

wherein the suction cleaning device simultaneously: a) dislodges particles from a surface; and, b) vacuums the dislodged particles into the suction cleaning device for storage;

wherein the brush structure comprises a foraminous tube, a plurality of inlet structures, an exterior screw thread, and a plurality of bristles;

wherein the plurality of inlet structures comprises the collection of apertures that forms the foraminous surface of the foraminous tube;

wherein the exterior screw thread is an exterior screw thread that attaches the brush structure to the vacuum structure;

wherein the plurality of bristles attach to the exterior surface of the lateral face of the foraminous tube;

wherein each of the plurality of inlet structures is identical;

wherein each of the plurality of inlet structures further comprises an intake aperture and an intake blade;

wherein each intake aperture is an aperture formed through the lateral face of the foraminous tube;

wherein each intake aperture allows a portion of the airflow to flow into the hollow interior of the foraminous tube;

wherein each intake blade is a blade that mounts on the interior surface of the foraminous tube such that the intake blade partially blocks the intake aperture associated with the intake blade;

wherein the intake blade deflects the direction of the airflow that passes through the intake aperture.

2. The suction cleaning device according to claim 1 wherein the vacuum structure is a housing;

wherein the vacuum structure is a rigid casing;

wherein the vacuum structure stores the particulate matter drawn into the vacuum structure by the brush structure.

3. The suction cleaning device according to claim 2 wherein the brush structure is a mechanical structure;

wherein the brush structure has the primary shape of a prism;

wherein the brush structure is a hollow structure;

wherein the brush structure is a tubular structure;

wherein the brush structure forms a fluidic connection from the exterior of the suction cleaning device into the vacuum structure.

4. The suction cleaning device according to claim 3 wherein the brush structure is a rotating structure;

wherein the rotation of the brush structure releases the particulate matter from a surface and draws the released particulate matter into the interior of the brush structure for transport into the vacuum structure.

5. The suction cleaning device according to claim 4 wherein the vacuum circuit is an electric circuit;

wherein the vacuum circuit generates a vacuum that creates an airflow through the vacuum structure and the brush structure;

wherein the vacuum generated by the vacuum circuit creates an airflow through the lateral face of the foraminous tube into the brush structure and through the hollow structure of the brush structure into the vacuum structure;

wherein the vacuum structure contains the vacuum circuit.

6. The suction cleaning device according to claim 5 wherein the vacuum circuit is an independently powered electric circuit;

wherein by independently powered is meant that the vacuum circuit can operate without an electrical connection to an external power source.

7. The suction cleaning device according to claim 6 wherein the vacuum structure comprises a vacuum housing, a vacuum fan, and a telescopic handle;

wherein the vacuum fan mounts in the vacuum housing;

wherein the telescopic handle attaches to the vacuum housing.

8. The suction cleaning device according to claim 7 wherein the vacuum circuit comprises a master switch, a power circuit, and the vacuum fan;

wherein the master switch, the power circuit, and the vacuum fan are electrically interconnected.

9. The suction cleaning device according to claim 8 wherein the vacuum housing is a composite prism structure;

wherein the vacuum housing contains the vacuum circuit;

wherein the brush structure attaches to the vacuum housing;

wherein the vacuum housing comprises a housing shell and a filter;

wherein the vacuum housing contains the filter;

wherein the housing shell is a hollow composite prism structure;

wherein the housing shell has a capped tube structure;

wherein the housing shell is formed as a segmented tube;

wherein the housing shell is formed as a center capped tube.

10. The suction cleaning device according to claim 9 wherein the housing shell further comprises a dirt chamber, a vacuum chamber, and a circuit chamber;

wherein the dirt chamber is a tubular structure;

wherein the dirt chamber is a prism-shaped structure;

wherein the congruent ends of the dirt chamber are geometrically identical to the congruent ends of the vacuum chamber and the circuit chamber;

wherein the dirt chamber attaches the vacuum chamber to the open congruent end of the capped tube structure of the brush structure;

wherein the vacuum chamber is a capped structure;

wherein the vacuum chamber is a prism-shaped structure;

wherein the congruent ends of the vacuum chamber are geometrically identical to the congruent ends of the circuit chamber;

wherein the vacuum chamber attaches the circuit chamber to the dirt chamber;

wherein the vacuum chamber contains the vacuum fan;

wherein the vacuum chamber and the dirt chamber are joined to form a composite prism structure;

wherein the vacuum chamber and the dirt chamber are joined to form a segmented tube;
wherein the vacuum chamber and the dirt chamber are bifurcated into their segments by the filter;
wherein the vacuum chamber is formed with apertures that discharges the airflow;
wherein the circuit chamber is a tubular structure with two closed ends;
wherein the circuit chamber is a prism-shaped structure;
wherein the congruent ends of the circuit chamber are geometrically identical to the congruent ends of the vacuum chamber;
wherein the circuit chamber attaches to the vacuum chamber to form a composite prism structure;
wherein the circuit chamber attaches to the vacuum chamber to form a capped tube structure;
wherein the circuit chamber contains the vacuum circuit;
wherein the circuit chamber is formed with all apertures required to accommodate the operation of the vacuum circuit.

11. The suction cleaning device according to claim 10
wherein the filter is a disk-shaped surface filter;
wherein the filter installs in the hollow tubular structure of the housing shell;
wherein the filter bifurcates the interior space of the housing shell to form the segmented sections of the segmented tube structure of the housing shell;
wherein the airflow passes through the filter as it flows from the dirt chamber into the vacuum chamber;
wherein the particulate matter is stored within the dirt chamber.

12. The suction cleaning device according to claim 11
wherein the dirt chamber further comprises an interior screw thread;
wherein the interior screw thread is formed on the end of the dirt chamber that is distal from the vacuum chamber.

13. The suction cleaning device according to claim 12
wherein the telescopic handle is a grip used to carry and manipulate the suction cleaning device;
wherein the span of the length of the telescopic handle is adjustable;
wherein the telescopic handle attaches to the congruent end of the circuit chamber of the housing shell of the vacuum housing of the vacuum structure that is distal from the brush structure;
wherein the telescopic handle further comprises a first arm, a second arm, and a detent;
wherein the detent is a mechanical structure that locks and secures the first arm to the second arm;
wherein the first arm is a hollow first prism-shaped structure that is further defined with an inner dimension;
wherein the second arm is a second prism-shaped structure that is further defined with an outer dimension;
wherein the first arm and the second arm are geometrically similar;
wherein the span of the outer dimension of the second arm is less than the span of the inner dimension of the first arm such that the second arm inserts into the first arm in a telescopic manner to form a composite prism structure;
wherein the span of the length of the telescopic handle adjusts by adjusting the relative position of the second arm within the first arm;
wherein the position of the second arm relative to the first arm is held in position using the detent.

14. The suction cleaning device according to claim 13
wherein the foraminous tube is a prism-shaped structure;
wherein the foraminous tube is a hollow structure;
wherein the foraminous tube has the structure of a capped tube;
wherein the foraminous tube is a rotating structure;
wherein the foraminous tube forms the primary shape of the brush structure;
wherein the lateral face of the foraminous tube is formed as a foraminous surface through which the airflow that passes into the suction cleaning device flows;
wherein the airflow passes through the plurality of inlet structures from the exterior of the foraminous tube into the interior of the foraminous tube.

15. The suction cleaning device according to claim 14
wherein the exterior screw thread is an exterior screw thread that attaches the brush structure to the vacuum structure;
wherein the interior screw thread is sized to receive the exterior screw thread of the brush structure;
wherein the exterior screw thread attaches the brush structure by screwing into the interior screw thread of the dirt chamber of the vacuum structure;
wherein the foraminous tube attaches to the exterior screw thread such that the foraminous tube rotates relative to the exterior screw thread;
wherein the plurality of bristles attach to the exterior surface of the lateral face of the foraminous tube;
wherein each of the plurality of bristles attaches to the foraminous tube in the manner of a cantilever;
wherein the plurality of bristles are placed against a surface such that the rotation of the foraminous tube allows the friction generated by the plurality of bristles to release the particulate matter from the surface.

16. The suction cleaning device according to claim 15
wherein the vacuum fan is an electrically powered device;
wherein the vacuum fan is a bladed device that generates a pressure differential that creates a partial vacuum;
wherein the partial vacuum created by the vacuum fan draws the particulate matter released from a surface into the interior of the brush structure for transport into the vacuum structure.

17. The suction cleaning device according to claim 16
wherein the master switch is an electric switch;
wherein the master switch forms a series electric connection between the power circuit and the vacuum fan;
wherein the master switch controls the flow of electric power from the power circuit to the vacuum fan;
wherein the power circuit is an electrical circuit;
wherein the power circuit powers the operation of the vacuum circuit.

18. The suction cleaning device according to claim 17
wherein the power circuit further comprises a battery, a diode, a charging port, and an external power source;
wherein the external power source further comprises a charging plug;
wherein the battery, the diode, the charging port, the external power source, and the charging plug are electrically interconnected;
wherein the battery is further defined with a first positive terminal and a first negative terminal;
wherein the external power source is further defined with a second positive terminal and a second negative terminal;
wherein the battery is a rechargeable battery;
wherein the charging port is an electrical circuit that reverses the polarity of the rechargeable battery and provides the energy necessary to reverse the chemical processes that the rechargeable battery initially used to generate the electrical energy;

wherein the charging port forms an electrical connection to an external power source using a charging plug;

wherein the charging plug forms a detachable electrical connection with the charging port;

wherein the charging port receives electrical energy from the external power source through the charging plug;

wherein the diode is an electrical device that allows current to flow in only one direction;

wherein the diode installs between the rechargeable battery and the charging port such that electricity will not flow from the first positive terminal of the rechargeable battery into the second positive terminal of the external power source.

* * * * *